US006146101A

United States Patent [19]

Chang

[11] Patent Number: 6,146,101

[45] Date of Patent: Nov. 14, 2000

[54] AUTOMATIC CONTROL DEVICE FOR AN AIR COMPRESSOR

[76] Inventor: Ming-Yi Chang, No. 21, Lane 369, Sec. 3, Tatung Rd., Hsichih Chen, Taipei Hsien, Taiwan

[21] Appl. No.: 09/083,306

[22] Filed: May 22, 1998

[51] Int. Cl.[7] ..... F04B 49/00

[52] U.S. Cl. ..... 417/44.2; 417/42

[58] Field of Search ..... 417/44.1, 44.4, 417/44.2, 44.8, 42

[56] References Cited

U.S. PATENT DOCUMENTS

| | | | |
|---|---|---|---|
| 3,860,363 | 1/1975 | Silvern et al. | 417/12 |
| 4,819,123 | 4/1989 | Hatimaki | 361/23 |
| 4,863,355 | 9/1989 | Odagirl et al. | 417/12 |

*Primary Examiner*—Henry C. Yuen
*Assistant Examiner*—Arnold Castro
*Attorney, Agent, or Firm*—Thomas, Kayden, Horstemeyer & Risley, L.L.P.

[57] ABSTRACT

An automatic control device for an air compressor is disclosed. The air compressor controlled by the automatic control device is provided with two operation modes, one is the idle-running/heavy-running operation mode and the other one is the auto-stop/start operation mode. The automatic control device comprises a controller, a microswitch and an electromagnetic switch for controlling the air compressor to switch its operation mode between the idle-running/heavy-running and the auto-stop/start operation modes thereby enhancing the performance of the air compressor

1 Claim, 2 Drawing Sheets

AUTOMATIC CONTROL DEVICE FOR AN AIR COMPRESSOR

BACKGROUND OF THE INVENTION

1. Field of the Invention

The present invention relates to an automatic control device for an air compressor, more particular, to an automatic control device for an air compressor, which lowers down the waste of energy and avoids damages to the motor of the air compressor.

2. Description of Related Art

A conventional air compressor drives a motor to run for pumping air into an air tank when the air pressure in the air tank is lower than a preset low value such as 5 kilograms per square centimeters, and stops pumping air into the air tank with the motor in idle running when the air pressure therein reaches a preset high value such as 7 kilograms per square centimeters. The air pressure in the air tank shall be decreased due to the use of the air compressor and whenever it reaches the preset low value, the compressor starts to pump air into the air tank again. This procedure shall repeat for maintaining the air pressure in the air tank between the preset high and low values. This conventional air compressor is said to be operating in a heavy-running mode when it is pumping air into the air tank and in an idle-running mode when it stops pumping air into the air tank.

The previous conventional air compressor operating in such an idlerunning/heavy-running mode suffers a disadvantage in waste of energy because the motor is in idle running when the air compressor does not pump air into the air tank. To overcome this disadvantage, a second conventional air compressor operating in an auto-stop/start mode is provided. Similarly, this second conventional air compressor drives a motor to run for pumping air into an air tank when the air pressure in the air tank is lower than the preset low value. However, it stops pumping air into the air tank by stopping the motor when the air pressure in the air tank reaches a preset high value. When the air pressure in the air tank is decreased and has reached the preset low value, the compressor starts to pump air into the air tank again by restarting the motor. This procedure shall repeat for maintaining the air pressure in the air tank between the preset high and low values. This second conventional air compressor operating in the auto-stop/start mode avoids the waste of energy because the motor is stopped when the air compressor does not pump into the air tank. Unfortunately, the times that a motor can be restarted is restricted, for example six times per hour, in order to avoid over-heating to the coil of the motor and hence, the air compressor operating in the auto-stop/start mode is not satisfactory. Therefore, there is a continuing need for the above air compressors to be improved.

SUMMARY OF THE INVENTION

The general object of the present invention is to provide an automatic control device for an air compressor, which lowers down the waste of energy and avoids over-heating damage to the motor of the air compressor. The air compressor controlled by the automatic control device is provided with two operation modes, one is the idle-running/heavy-running operation mode and the other one is the auto-stop/start operation mode. The automatic control device comprises a controller, a microswitch and an electromagnetic for controlling the air compressor to switch its operation mode between the idlerunning/heavy-running operation mode and the auto-stop/start operation mode whereby the waste of energy is lowered down by operating in the auto-stop/start operation mode and the over-heating damage is avoided by operating in the idle-running/heavy-running mode.

Other objects, advantages, and novel features of the invention will become more apparent from the following detailed description when taken in conjunction with the accompanying drawings.

DETAILED DESCRIPTION OF PREFERRED EMBODIMENT

Figure 1:
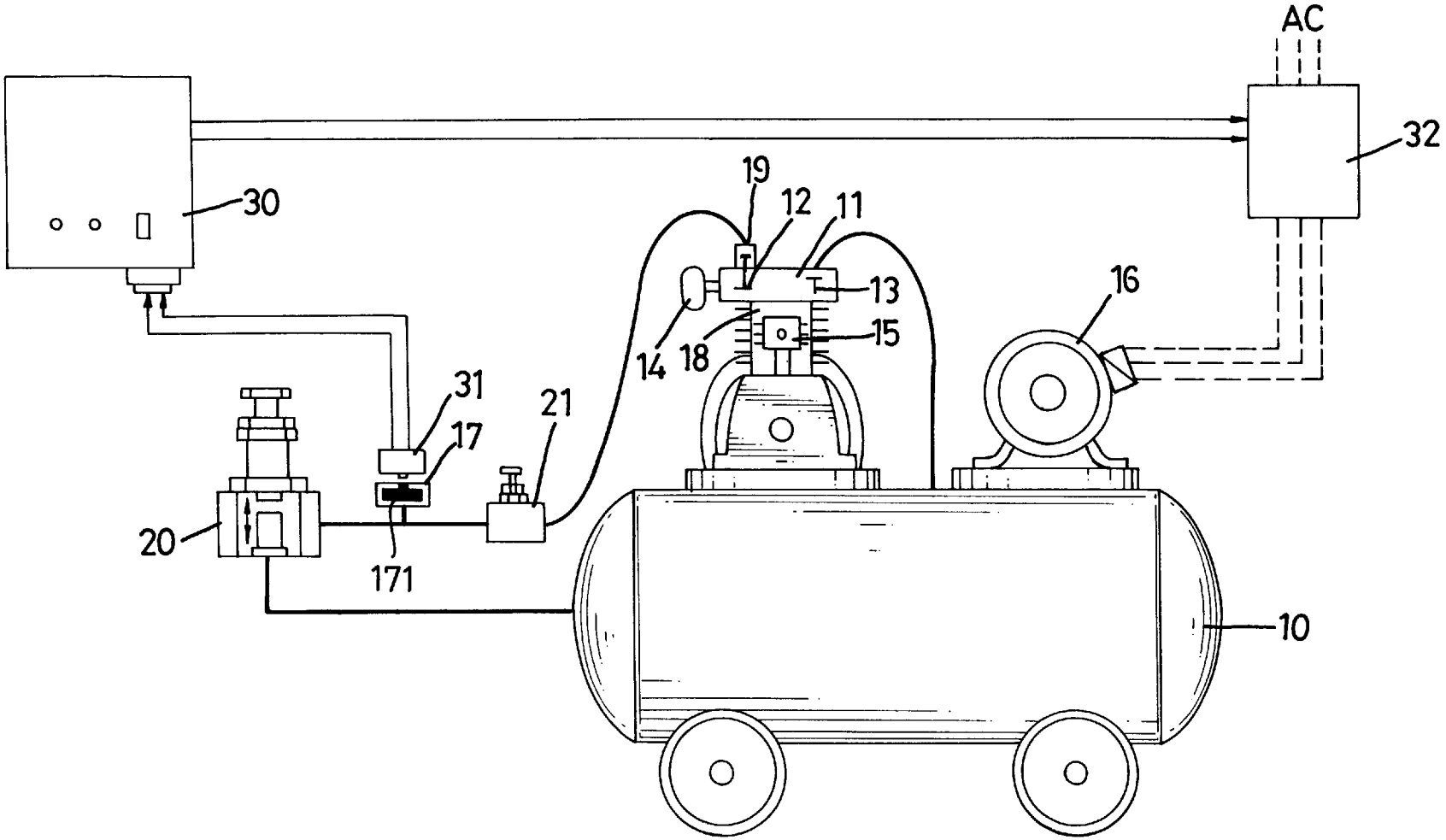
FIG. 1 is a schematic diagram showing the architecture of an air compressor with the automatic control device in accordance with the present invention.

Referring to FIG. 1, the schematic diagram of the air compressor with the automatic control device in accordance with the present invention is shown. The air compressor includes an air tank 10, a cylinder 18, a cylinder lid 11 mounted on the top of the cylinder, a piston 15 positioned in the cylinder lid 11 and a motor 16 for driving the piston 15. On the top of the cylinder lid 11, an inlet valve 12, an outlet valve 13 and an unloader 19 are provided. A back pressure valve 20 is connected to the air tank 10. The output of the back pressure valve is connected to an air pressure cylinder 17 and the inlet valve 12 on the cylinder lid 11. A speed controller 21 is provided between the back pressure valve 20 and the inlet valve 12 for extending the time period for the air compressor to transform its operation mode from the idle-running mode to the heavy-running mode thereby enabling the motor to start with less force.

The back pressure valve 20 is used for controlling the air pressure in the air tank 10. When the air pressure in the air tank 10 reaches the preset high value, the back pressure valve 20 is in open state to permit the compressed air to flow from the air tank 10 to the air pressure cylinder 17, and further to the unloader 19 through the speed controller 21 whereby the microswitch 31 is turned off and the inlet valve 12 is open so that the air compressor is operating in the idle-running mode.

When the air pressure in the air tank lowers down and reaches the preset low value, the compressed air in the unloader 19 slowly flows through the speed controller 21 to the back pressure valve 20 for being exhausted to the atmosphere wherein the back pressure valve 20 is closed and the microswitch 31 is off.

The air compressor start to operate in the heavy-running mode wherein the back pressure valve 20 is closed and wherein the motor 16 drives the piston 15 to move up and down and further operates the inlet valve 12 and outlet valve 13. The inlet valve 12 is open and the outlet valve 13 is closed for drawing air into the cylinder 18. Then, the inlet valve 12 is closed and the outlet valve 13 is open for pumping the compressed air into the air tank 10 through the outlet valve 13 thereby increasing the air pressure in the air tank 10.

When the air pressure in the air tank 10 reaches the preset high value, the back pressure valve 20 is open and the compressed air quickly flows through the speed controller 21 to the unloader 19 to open the inlet valve 12 thereby disabling the pump of air into the air tank 10.

In addition to controlling the air pressure in the air tank 10, the back pressure valve 20 also control the air pressure cylinder 17 to operate its cylinder piston 171 and further cooperates with the automatic control device to enable the air compressor to switch its operation mode between the idlerunning/heavy-running mode and the auto-stop/start mode.

Figure 2:
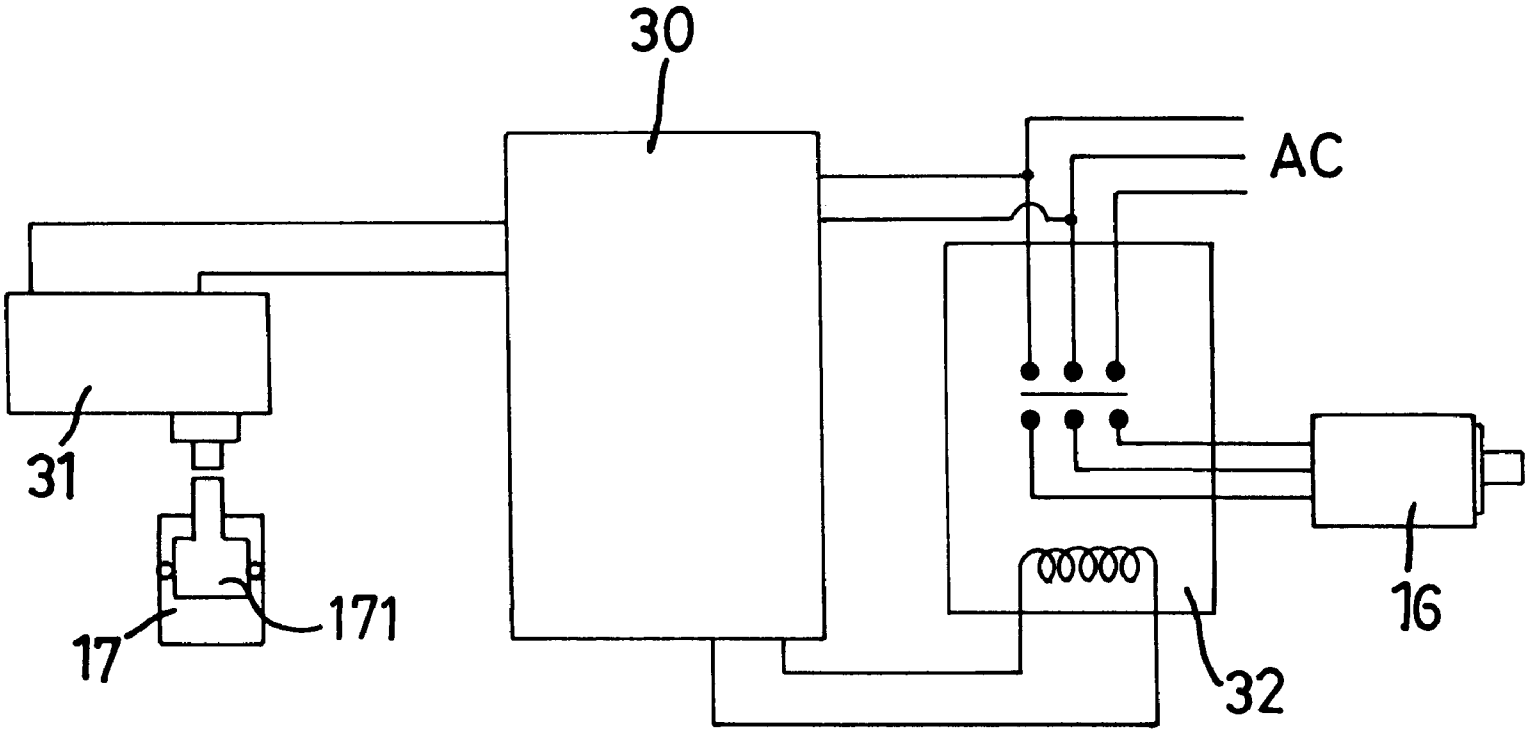
FIG. 2 is a block diagram of an automatic control device for the air compressor in accordance with the present invention.

Referring to FIG. 2, the automatic control device includes a controller 30, a microswitch 31 connected with an input terminal of the controller 30 and an electromagnetic switch 32 connected with an output terminal of the controller 30. Preferably, the controller 30 includes a microprocessor for providing timing and driving functions. The electromagnetic switch 32 is connected with the controller 30 with an exciting coil. The connection lines of the electromagnetic switch 32 are connected with an AC power source and the motor 16, respectively; that is, the electromagnetic switch 32 is used to power up or power down the motor 16.

The microswitch 31 is a normally closed contact switch. Therefore, the microswitch 31 is normally in on state for providing an ON signal to the controller 30, which stands for the heavy-running mode in the idlerunning/heavy-running operation mode. The electromagnetic switch 32 is turned on under the control of the controller 30 to keep the motor 16 in running. When the microswitch 31 is in off state, the air compressor is in idle-running mode and the electromagnetic switch 32 is still in on state under the control of the controller 30 to keep the motor 16 in idle running.

If the air compressor is in the auto-stop/start operation mode, the ON signal provided by the microswitch 31 stands for the start mode. The electromagnetic switch 32 is turned on under the control of the controller 30 to keep the motor 16 in running. When the microswitch 31 is in off state, the air compressor is in stop mode and the electromagnetic switch 32 is turned off under the control of the controller 30 to stop the motor 16.

The air pressure cylinder 17 is positioned under the microswitch 31 whereby the microswitch 31 can be turned on and off by a cylinder piston 171 of the air pressure cylinder 17. When the air pressure in the air tank 10 is lower than the preset high value, the cylinder piston 171 is not driven and the microswitch 31 is on. As soon as the air pressure in the air tank 10 reaches the preset high value, the cylinder valve 171 is driven to move up and the microswitch 31 is turned off. It is then decided by the controller whether the motor 16 continues running or not.

As described above, the operation mode of the air compressor is switchable under the control of the automatic control device and is switched between the idle-running/heavy-running and the auto-stop/start operation modes. This is accomplished by setting a time limit in the controller 30. The maximum time limit can be obtained from calculating 60/ST, where 60 stands for the number of minutes in one hour and ST stands for the maximum times that a motor can be started in one hour. Generally, the ST is equal to 6 and hence the maximum time limit is 10 minutes. The preferable time limit is about 8 minutes.

When the time period that the microswitch 31 is open is shorter than the time limit, the controller 30 controls the electromagnetic switch 32 under the idle-running/heavy-running mode; that is, even the microswitch 31 is open, the controller 30 still turns the electromagnetic switch 32 on and the motor 16 is in idle running.

If the time period that the microswitch 31 is open is longer than the time limit, the operation mode of the air compressor is switched from the idle-running/heavy-running operation mode to the auto-stop/start operation mode under the control of the controller 30. The controller 30 turns the electromagnetic switch 32 off and the motor 16 stops running whereby the waste of energy caused by the idle running of the motor 16 is avoided.

Under the auto-stop/start mode, if the time period that the motor 16 keeps in stop is shorter than the time limit, the operation mode is switched to the idle-running/heavy-running mode, based on the reason that the times that the motor 16 can be started is restricted.

From the above description, it should be clear that the present invention is able to switch the operation mode of the air compressor between the idlerunning/heavy-running and the auto-stop/start operation mode, thereby reducing the waste of energy caused by the idle running of a motor and avoid the burning damage to the motor.

Although the present invention has been explained in relation to its preferred embodiment, it is to be understood that many other possible modifications and variations can be made without departing from the spirit and scope of the invention as hereinafter claimed.

What is claimed is:

1. An automatic control device for controlling an air compressor, said air compressor being provided with both an idle-running/heavy-running and an auto-stop/start operation mode wherein a motor of said air compressor is switchable between idle running and heavy running in said idle running/heavy running operation mode and is switchable between stopping when said air compressor does not pump air into an air tank thereof and starting in said auto-stop/start operation mode, said automatic control device comprising:

a controller for controlling said air compressor to switch between said idle running/heavy running operation mode and said auto-stop/start operation mode mode and including a micro-processor for providing timing and driving functions;

a microswitch which is a normally closed contact switch controlled by said controls and coupled to an air pressure cylinder of said air compressor; and an electromagnetic switch controlled by said controller and connected between said motor and a power source wherein a speed control is further provided between a back pressure valve and an inlet valve of said air compressor for extending the time period for said compressor to switch from idle running to heavy running.

* * * * *